US007798990B2

(12) United States Patent
Kahen

(10) Patent No.: US 7,798,990 B2
(45) Date of Patent: Sep. 21, 2010

(54) DISPOSABLE MOUTHWASH CONTAINER

(76) Inventor: Soleyman Kahen, 2215 Tunbridge Ct., Los Angeles, CA (US) 90077

( * ) Notice: Subject to any disclaimer, the term of this patent is extended or adjusted under 35 U.S.C. 154(b) by 1199 days.

(21) Appl. No.: 11/351,536

(22) Filed: Feb. 9, 2006

(65) Prior Publication Data

US 2006/0142693 A1 Jun. 29, 2006

Related U.S. Application Data

(63) Continuation-in-part of application No. 11/084,744, filed on Mar. 18, 2005, now abandoned.

(51) Int. Cl.
*A61J 7/00* (2006.01)

(52) U.S. Cl. ..... 604/77

(58) Field of Classification Search ..... 604/77, 604/78; 206/63.5, 438; 424/49; 220/495.01
See application file for complete search history.

(56) References Cited

U.S. PATENT DOCUMENTS

| | | | | | |
|---|---|---|---|---|---|
| 2,286,957 | A * | 6/1942 | Du Val et al. | 604/77 |
| 2,550,210 | A * | 4/1951 | Vance, Jr. | 222/320 |
| 2,553,232 | A * | 5/1951 | Beyer | 206/63.5 |
| 2,898,003 | A * | 8/1959 | Wilson et al. | 222/107 |
| 3,514,029 | A * | 5/1970 | Powell | 206/223 |
| 4,078,566 | A * | 3/1978 | Urban, Jr. | 604/514 |
| 4,235,343 | A * | 11/1980 | Thompson | 215/6 |
| 5,002,189 | A * | 3/1991 | Sahi | 229/123.2 |
| 5,364,348 | A * | 11/1994 | Berry, Sr. | 604/77 |
| 5,395,392 | A * | 3/1995 | Suhonen | 606/234 |
| 6,110,193 | A * | 8/2000 | Chen | 606/234 |
| 6,199,711 | B1 * | 3/2001 | Lansky | 220/255 |
| 6,258,057 | B1 * | 7/2001 | Marinello et al. | 604/77 |
| 6,503,222 | B2 * | 1/2003 | Lo | 604/77 |
| 2002/0104856 | A1 * | 8/2002 | Clark et al. | 222/633 |
| 2004/0158200 | A1 * | 8/2004 | Berry, Sr. | 604/77 |
| 2005/0245861 | A1 * | 11/2005 | Dunn et al. | 604/77 |
| 2006/0142693 | A1 * | 6/2006 | Kahen | 604/77 |

* cited by examiner

*Primary Examiner*—Kevin C Sirmons
*Assistant Examiner*—Michael J Anderson
(74) *Attorney, Agent, or Firm*—Robert J. Lauson; Lauson & Tarver LLP

(57) ABSTRACT

A disposable mouthwash container for use at a location such as a restaurant or preparatory to a meeting, for quick and easy rinsing of the user's mouth and to receive the used mouthwash back into the same container and be re-sealed for disposal. Each embodiment of the invention seals the mouthwash liquid in a reservoir in the container and has an easily openable top and spout providing access to the mouthwash, and a return opening for directing the used mouthwash back into the container, which is reclosable for disposal. A quick-release split ring connection is provided for mounting the container on a key ring for ready availability, and a reflective tape mirror is provided on some embodiments to facilitate inspection after use.

9 Claims, 4 Drawing Sheets

DISPOSABLE MOUTHWASH CONTAINER

CROSS-REFERENCE TO RELATED APPLICATION

This application is a Continuation-In-Part of application Ser. No. 11/084,744 filed on Mar. 18, 2005, now abandoned, the entire contents of which are hereby incorporated by reference and for which priority is claimed under 35 U.S.C. §120.

BACKGROUND OF THE INVENTION

This invention relates to a disposable mouthwash container adapted to be carried by a user and available for use in locations remote from the user's home, such as after a meal at a restaurant or preparatory to a meeting to freshen the mouth and breath, typically with a sufficient amount of liquid for a single treatment.

Disposable containers have been known for this purpose, including the one shown in U.S. Pat. No. 6,258,057, wherein an elongated packet comprises a receptacle member having a mouthwash supply chamber at one end and a larger recovery chamber at the other, with membrane members and puncturing elements and relatively bulky and complex construction.

SUMMARY OF THE INVENTION

The present invention resides in a small and more easily portable mouthwash container that is very simple and inexpensive in construction and easy to use, typically with one hand, that dispenses the stored mouthwash neatly and easily into the user's mouth, and receives the used mouthwash back into the container, also neatly and easily. The invention is embodied in several different forms that are shown herein for purposes of illustration.

DETAILED DESCRIPTION OF THE INVENTION

Figure 1:
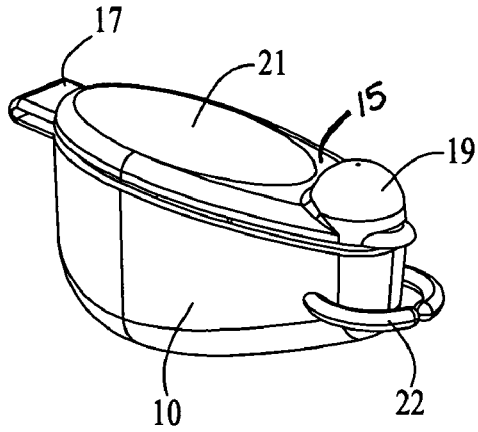
FIG. 1 is a front perspective view of a mouthwash container that is a first embodiment of the invention.
Figure 2:
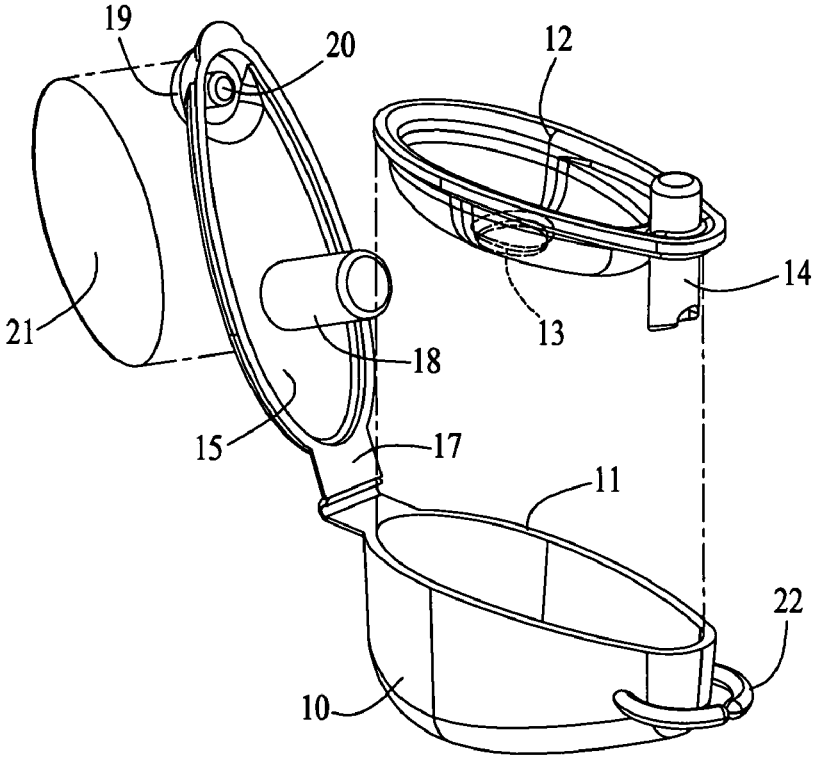
FIG. 2 is an exploded perspective view of the mouthwash container of FIG. 1, with parts in moved positions to illustrate an "open" condition.

FIGS. 1 and 2 of the drawings illustrate a first embodiment of the invention in which a quantity of mouthwash liquid can be stored in a small, tub-like elongated oval container 10 having an open top 11 and a tub-like sink insert 12 forming a false bottom spaced above the bottom of the tub. The insert is formed with a drain hole 13 in the center and carries a hollow spout or straw 14 at one end, passing through the insert and opening into the lower portion of the tub. The container has a generally flat, elongated cover 15 that is joined to the body by an integral or living hinge 17 and carries a central plug 18 for closing the hole in the insert.

The cover has a dome 19 at the free end, over a depending plug 20 for fitting into the straw 14. The cover seals against the body when closed, and opens to provide access to the straw, through which the user takes in the liquid, preferably tipping the container toward the straw 14. After rinsing the mouth, the user spits the liquid back into the sink insert.

The elongated generally oval open top 11 is sized and shaped to fit around the mouth, in a general "lip shape," and the drain hole 13 permits the excess to pass from the sink into the body. The cover is reclosable for disposal of the used mouthwash. A reflective tape 21 on the outside of the cover forms a mirror for inspection of the mouth area after use, and a split ring 22 on one end forms a quick-release key ring for mounting the container on an automobile key or the like, for ready availability.

FIGS. 3 through 10 of the drawings show a second embodiment of the invention, using a bellows-shaped container 30 composed of flexible material and having a central groove 31 and an open top 32. The top is fitted with a dished annular mouthpiece 33, having an upstanding spout 34. Fitted in the mouthpiece around the spout is a ring of absorbent material 35, and a circular cover 37 fits over the open end and seals against the body of the container, which holds a quantity of mouthwash liquid. A depending hollow sleeve 38 (see FIG. 10) on the cover 37 fits into and seals the spout 34 until the cover is removed. The central bellows portion of this embodiment is compressible to dispense the liquid mouthwash, and is expandable, by pulling the lower end downwardly away from the top, to draw the used mouthwash back through the spout into the container after use, and to provide extra capacity for saliva. A key ring attachment 39 is formed as a split ring on the bottom of the container, and serves as a grip for expanding the bellows. The absorbent material 35 neatly receives any leakage around the spout, and the cover is reclosable, as in the first embodiment.

Figure 3:
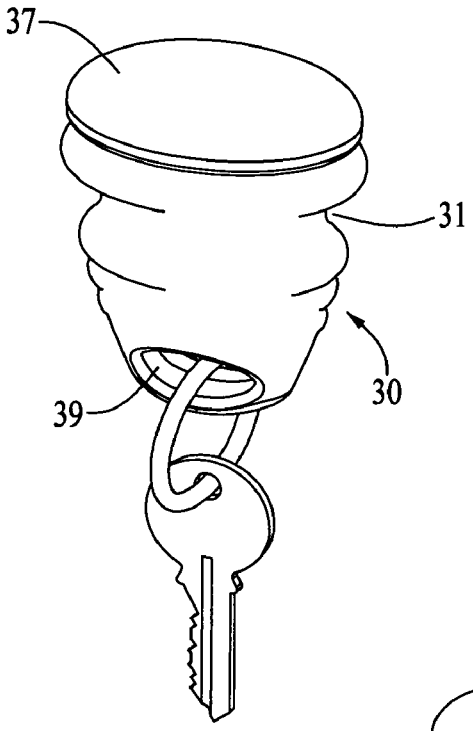
FIG. 3 is a front perspective view of a mouthwash container constituting a second embodiment of the invention, with a representative key attached to the container on a keyring.
Figure 4:
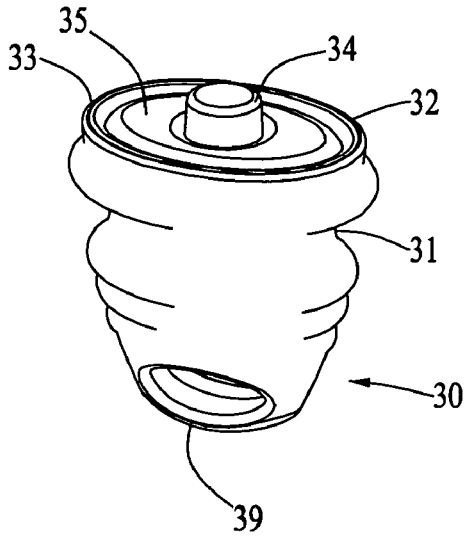
FIG. 4 is a view of the body of the container of FIG. 3 with the key, keyring and cover removed.
Figure 5:
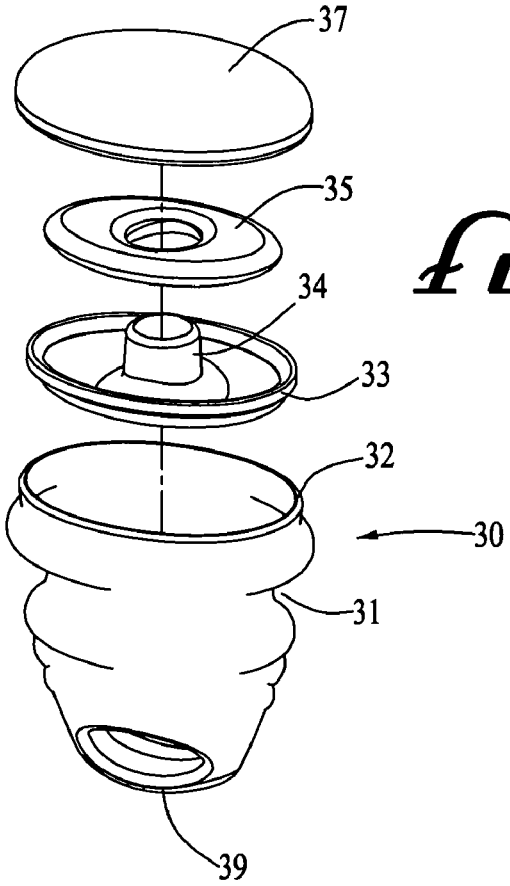
FIG. 5 is an exploded perspective view of the container of the second embodiment.
Figure 6:
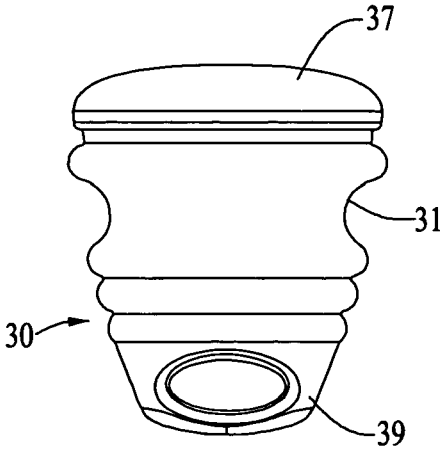
FIG. 6 is a front elevational view of the container of FIG. 5.
Figure 7:
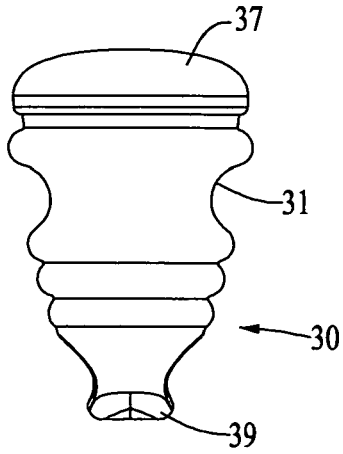
FIG. 7 is a right side elevational view of the container of FIG. 6.
Figure 8:
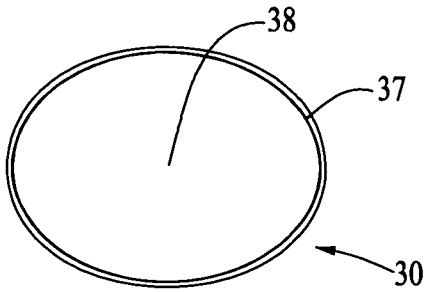
FIG. 8 is a top plan view of the container of FIG. 7.
Figure 9:
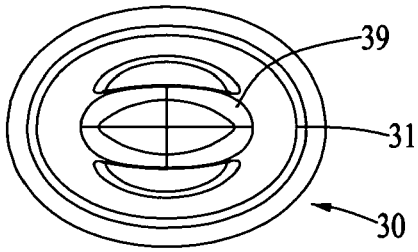
FIG. 9 is a bottom plan view of the container of FIG. 7.
Figure 10:
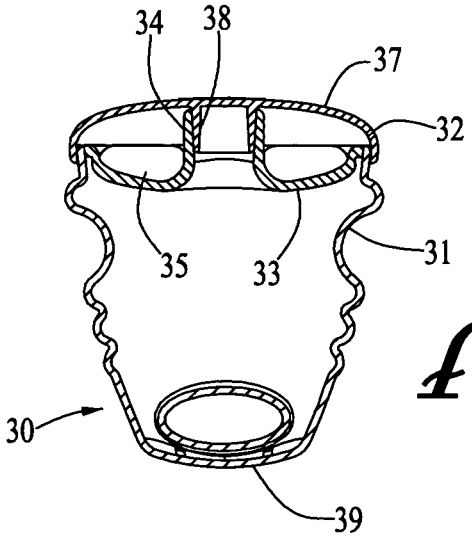
FIG. 10 is a cross-sectional view taken substantially in a central vertical plane through the container of FIG. 6.
Figure 11:
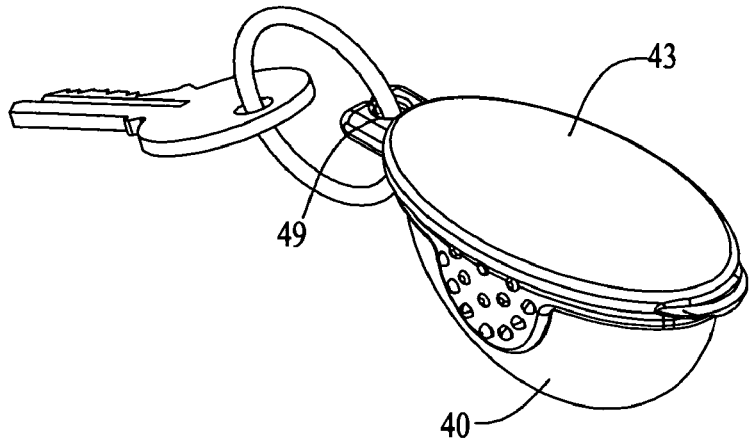
FIG. 11 is a front perspective view of a third embodiment of the invention, also shown with an attached key and keyring.
Figure 12:
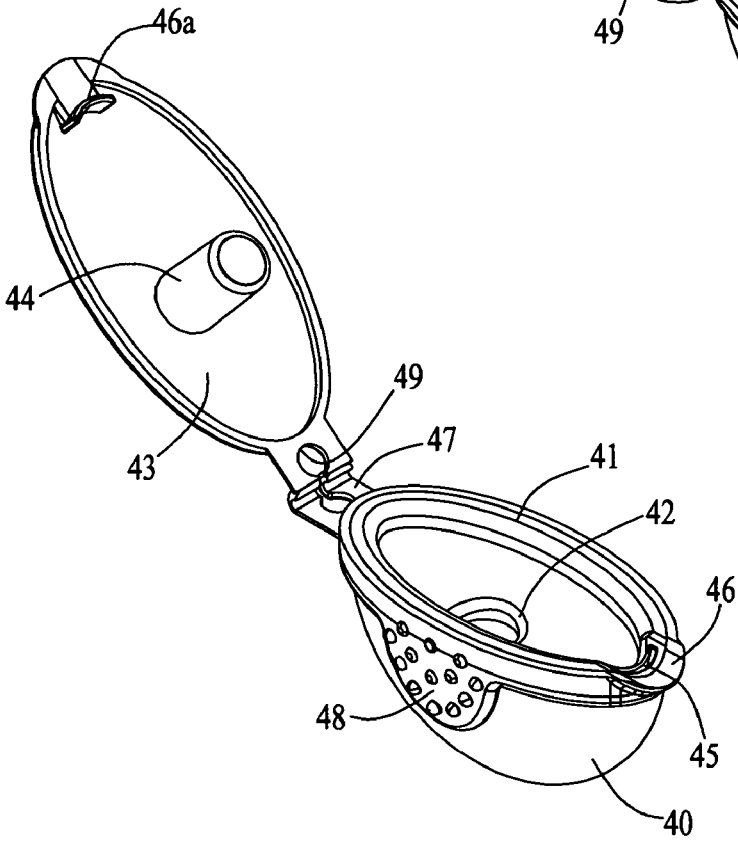
FIG. 12 is a perspective view similar to FIG. 11 with parts in moved positions to illustrate an "open" condition.
Figure 13:
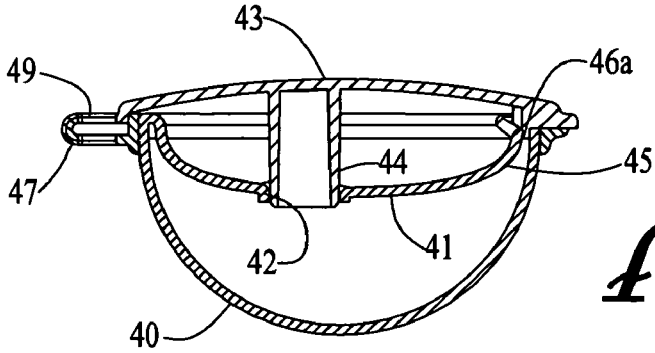
FIG. 13 is a cross-sectional view taken substantially in a central vertical plane through the container of FIG. 11.

FIGS. 11 through 13 show another embodiment of the invention in which a container in the form of a flexible rubber bulb or body 40 of somewhat flattened circular cross-sectional shape is fitted with a sink insert 41, as in the first embodiment, having a drain hole 42 overlying a reservoir in the body, and a one-piece cover or lid 43, with a depending sleeve 44 that seals the sink hole, when the lid is closed, retaining the mouthwash in the compartment defined between the sink and the cover. When the cover is lifted, the liquid is taken into the mouth from a mouthpiece slot or spout 45 (and an aligned trough 46) from the reservoir under the insert, by tipping the open container toward the user. The cover is hingedly mounted on an integral strap 47 on one end and has a depending sealing tab **46*a* on the opposite end for fitting into the slot 45 that forms the mouthpiece spout, as shown in FIG. 3. The body 40 also carries two squeeze-pads 48 on opposite sides for assisting in dispensing liquid from the flexible container. These pads are squeezed together to dispense the liquid. To facilitate the return of the mouthwash, they are released so that the resilience of the container will expand the container and draw the mouthwash into the reservoir. The cover is reclosable for disposal of the used mouthwash. A quick-release key ring connector 49** is formed in the hinge strap at one end of the cover.

From the foregoing, it will be seen that the present embodiment provides a simple and inexpensive disposable mouthwash container that has a normally closed reservoir for holding a body of mouthwash, with a dispensing opening easily accessed by opening the cover, and with a convenient and easily used sink for receiving the used mouthwash back into the container after use. The inventions is shown and described in three embodiments, which illustrate different forms the container may take. Other forms may be used without departing from the invention.

I claim as my invention:

1. A disposable mouthwash container for holding and dispensing a body of liquid mouthwash and receiving the mouthwash for disposal after use, comprising:

a container body having an open side and defining a reservoir for the mouthwash;

a dished sink fitted in said open side over said reservoir and forming an internal top wall for the reservoir, said sink having a drain hole passage and a hollow straw passing through the sink and opening into the reservoir, permitting flow of mouthwash therethrough;

and a movable cover for said container body overlying said sink and normally releasably closing said open side, said cover having a plug thereon for closing said drain hole passage and said straw in said sink when the cover is in a closed position against the open side and for opening said passage when the cover is in an open position spaced from said open side.

2. A mouthwash container as defined in claim 1 wherein the container body and the sink are elongated and shaped to fit around the mouth of a user for return of used mouthwash to the reservoir through the sink.

3. A mouthwash container as defined in claim 1 wherein the container body is bellows shaped and composed of flexible material permitting contraction of the container during dispensing of the mouthwash and expansion of the container body during return of the mouthwash to the container.

4. A mouthwash container as defined in claim 3 wherein said dished sink is a shallow mouthpiece and said drain hole passage is defined by an upstanding spout, and said cover has a wall closing said spout when the cover is in the closed position.

5. A mouthwash container as defined in claim 4 further including an absorbent ring around said upstanding spout.

6. A mouthwash container as defined in claim 1 wherein the container body is in the form of a flexible bulb of flattened circular cross-sectional shape, and said cover has a depending member that closes and seals the drain hole passage through said sink when the cover is closed, said sink and said container body defining a mouthpiece spout on one side for dispensing the liquid.

7. A mouthwash container as defined in claim 6 wherein said bulb has squeeze pads on the flattened sides thereof.

8. A mouthwash container as defined in claim 1 further including a strip of reflective material on said cover forming a mirror.

9. A mouthwash container as defined in claim 1 further including a split ring connector on said container body for coupling the container to a key ring.

* * * * *